US006398952B1

(12) United States Patent
Baer

(10) Patent No.: US 6,398,952 B1
(45) Date of Patent: Jun. 4, 2002

(54) STATIONARY POOL LEAF NET FILTER

(76) Inventor: James Baer, 4794 Jody Lynn Dr., Mentor, OH (US) 44060

( * ) Notice: Subject to any disclaimer, the term of this patent is extended or adjusted under 35 U.S.C. 154(b) by 0 days.

(21) Appl. No.: 09/919,166

(22) Filed: Jul. 31, 2001

Related U.S. Application Data

(63) Continuation-in-part of application No. 09/425,821, filed on Oct. 22, 1999, now abandoned.

(51) Int. Cl.[7] ..... E04H 4/16
(52) U.S. Cl. ..... 210/169; 210/232; 210/238
(58) Field of Search ..... 210/169, 232, 210/238, 416.2, 473; 4/490; 15/1.7

(56) References Cited

U.S. PATENT DOCUMENTS 2,989,185 A * 6/1961 Lombardi
3,625,364 A * 12/1971 La Chance
3,863,237 A * 1/1975 Doerr
4,369,109 A * 1/1983 Edge
5,173,181 A * 12/1992 McFarland
5,487,830 A * 1/1996 Huppert

* cited by examiner

*Primary Examiner*—David A. Simmons
*Assistant Examiner*—Fred Prince
(74) *Attorney, Agent, or Firm*—John D. Gugliotta

(57) ABSTRACT

A collection device is provided for collecting floating leaves, bugs, and other surface debris in a swimming pool. A leaf net is attached to a bracket that is clamped/mounted to the edge of a swimming pool. The leaf net extends a minimal horizontal distance into the water of a pool to minimize swimmer interference, has a low profile so that it will not interfere with a pool cover, and easily slides off of the mounting pole for containment of and removal of collected debris.

5 Claims, 2 Drawing Sheets

STATIONARY POOL LEAF NET FILTER

RELATED APPLICATIONS

The present invention is a Continuation in Part of Ser. No. 09/425,821, filed on Oct. 22, 1999, now abandoned.

BACKGROUND OF THE INVENTION

1. Field of the Invention

The present invention relates to pool cleaning devices and more particularly pertains to a pool skimming device which utilizes a commercially available pool leaf net and a simple clamping/universal mounting bracket positioned in such a manner as to collect for removal debris from the surface of a swimming pool.

2. Description of the Related Art

Various devices for skimming debris off the surface of a swimming pool have been developed to remove the debris before it settles to the bottom of a swimming pool or clogs the main filter inlet.

A search of the prior art did not disclose any patents that read directly on the claims of the instant invention; however, the following references were considered related:

| U.S. Pat. No. | Inventor | Issue Date |
|---|---|---|
| 3,152,076 | Freutzer | 10/1964 |
| 3,245,420 | Cherney | 04/1966 |
| 3,625,364 | La Chance | 12/1971 |
| 3,863,237 | Doerr | 01/1975 |
| 4,152,801 | Lieber | 5/1979 |
| 4,225,436 | Cseh | 09/1980 |
| 4,369,109 | Edge | 01/1983 |
| 4,481,117 | Collins | 11/1984 |
| 4,555,334 | Cohen | 11/1985 |
| 4,575,423 | Alanis | 03/1986 |
| 5,135,579 | Goetti | 08/1992 |
| 5,265,631 | Goetti | 11/1993 |

The most common of these devices is a pool leaf net connected to a long pole. A person is then required to move the pole and net around the pool trying to collect a never-ending stream of debris collecting on the surface of a swimming pool. The other type is a net, etc. attached to the edge of the pool. Reference is made to a permanent pool skimming net design in U.S. Pat. No. 4,369,109 issued to Edge on Jan. 18, 1983 and U.S. Pat. No. 3,625,364 issued to La Chance on Dec. 7, 1971. These designs used a large specially designed frame or pole and long flat surfaced nets to collect surface debris. These flat nets are bulky and could drop collected debris back into the swimming pool when removed for cleaning.

Consequently, the need for a permanently mounted, compact, economical, surface debris skimming system still exists.

SUMMARY OF THE INVENTION

It is therefore an objective of the present invention to provide an improved automatic, surface debris, skimming device.

It is another objective of the present invention to utilize a commercially available, hand held pocket type leaf net in combination with the present invention in a manner that attaches said leaf net to a permanent clamping/universal mounting bracket, thereby providing a continuous collecting debris surface skimming device.

It is further objectives of the present invention to provide a swimming pool skimming device which is economical enough for others to purchase, easy to install, economical to ship, easy to manufacture, and does not have the disadvantages of special nets and large cumbersome size employed by prior art edge mounted, net type skimming devices.

These and other objectives and advantages reside in the details of construction and operation of the present invention here in claimed and described, reference being made to the accompanying drawings forming a part here of, wherein like numerals refer to like parts throughout.

Briefly described according to one embodiment of the present invention, referred to as the preferred embodiment for purposes of disclosing the best mode of the invention, a leaf net is attached to a bracket that is clamped/mounted to the edge of a swimming pool. The leaf net extends a minimal horizontal distance into the water of a pool to minimize swimmer interference, has a low profile so that it will not interfere with a pool cover, and easily slides off of the mounting pole for containment of and removal of collected debris.

It is an advantage of the present invention to provide a collecting net which does not lose containment of the collected debris.

Another advantage of the present art is to have a clamping devise that can be used on the majority of swimming pools that does not require putting mounting holes in the edge of a pool, and can be easily removable for winter storage.

It is another advantage of the present invention to provide an alternate universal mounting device which can be used on swimming pools that have edges that are not suitable for the clamping device.

It is another advantage of the present invention to use a minimum number of components to reduce malfunctions, maintenance, and the need to replace expensive components.

It is another advantage of the present invention to provide a method of leaf net filter removal that does not involve any type of mechanical locking mechanism.

It is yet another advantage of the present invention to provide a means to remove surface debris from a swimming pool before it sinks to the bottom of the pool or clogs the main pool filter.

Finally, it is another advantage of the present invention to provide a swimming pool surface which is continually cleansed of surface debris and biting bugs with no need for continuous human involvement except for the removal of the collected debris, and reduce the time required for vacuuming the bottom of the swimming pool.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
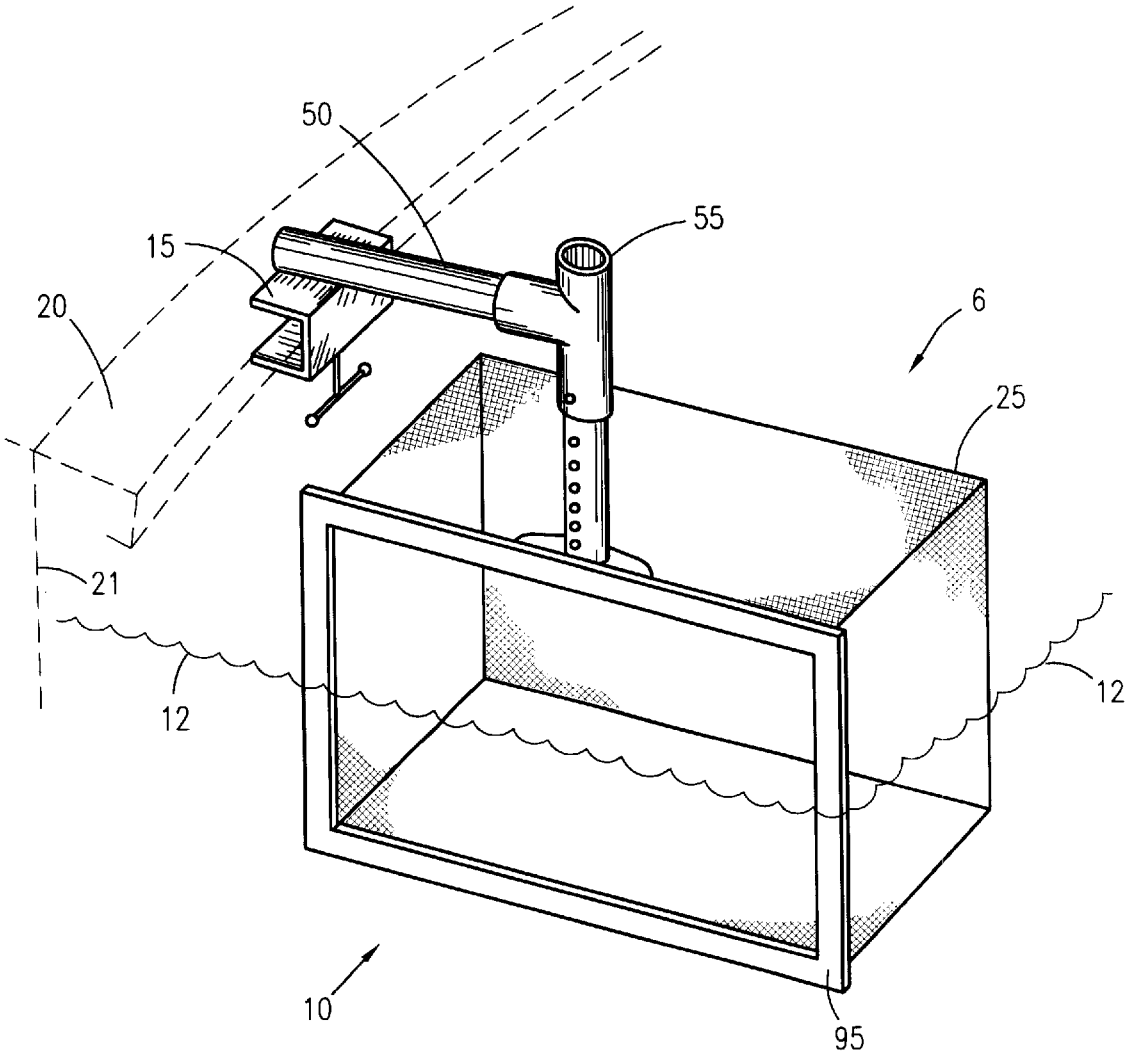
FIG. 1 is an front perspective view of the stationary pool leaf net filter according to a preferred embodiment of the present invention.

Referring to the drawings and starting with FIG. 1, there is shown a stationary pool leaf net filter assembly, generally noted as 6, embodying the principles and concepts of the present invention. The apparatus 6 is attached to the outer top edge of a swimming pool 20 through the use of a clamping means 15 affixed to net attaching bracket 55 by a mounting pole 50. It is envisioned that the features and benefits of the present invention can be best realized and accomplished through the use of an otherwise commercially available leaf net 25 partially extending into the swimming pool's water so that a portion of the leaf net 25 is above the water line 12 and the balance of the leaf net 25 is below the waterline.

Figure 2:
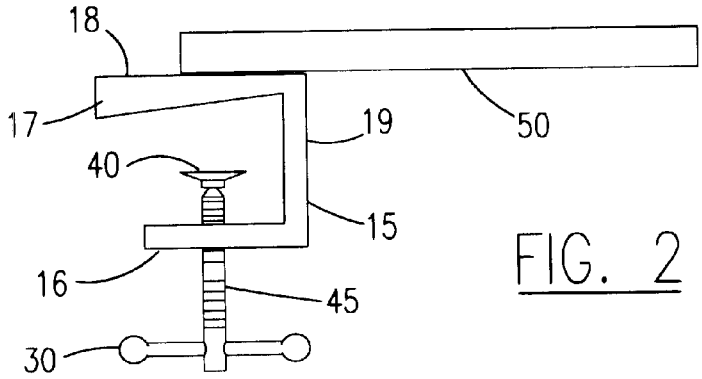
FIG. 2 is a partial exploded perspective view of a simple clamping device for use with the present invention.

Referring now to FIG. 2, a clamping device 15 is shown in greater detail embodying a method of clamping the stationary pool leaf net filter 6 to the edge of a swimming pool 20 (not herein shown). A swivel cap 40 terminates the upper end of a threaded shaft 45 so that it will not rotate against the pool edge while it is urged by a handle 30 in physical communication with the end of the shaft 45 opposite said swivel cap 40. The horizontal length of clamp 15 keeps the clamp 15 from rotating due to the rotational force applied to it by the leaf net 25. The upper edge 17 of clamp 15 extends laterally beyond lower edge 16 for additional upper clamping surface area. Mounting pole 50 is attached perpendicularly along a linearly elongated centerline of an upper surface 18 of the upper edge 17 of the clamp 15, thereby forming an angle slightly greater than 90° with respect to the mounting pole 50 and a lateral, outer surface 19 of the clamp 15. The mounting pole 50 functions as an attachment means as will be described in greater detail below.

Figure 3:
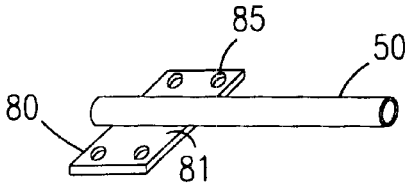
FIG. 3 is a similar perspective view thereof depicting a first alternate embodiment for a universal mounting device that is secured with fasteners to the edge of a swimming pool.

In FIG. 3, an alternate embodiment is disclosed for a universal mounting device showing the same mounting pole 50 as on clamping device 15 above. Mounting pole 50 is attached transversely and perpendicularly along a linearly elongated centerline of an upper surface 81 of a plate 80. Plate 80 has holes 85 for fasteners to secure the universal mounting device to the edge of a swimming pool which can not use the clamping device 15.

Figure 4:
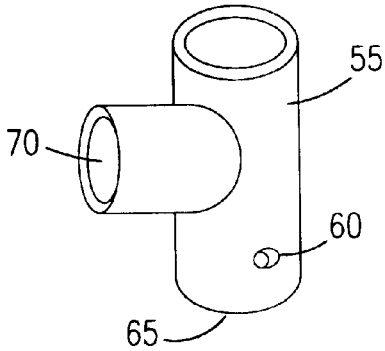
FIG. 4 is a perspective view of a net attaching bracket for use with the present invention.

Referring now to FIG. 4, the net attaching bracket 55 is shown in greater detail. The net attaching bracket 55 is connected to the mounting pole 50 through end 70 and is kept on mounting pole 50 by its forward angle and the force of the swimming pool's circulating water 10. The leaf net 25 is inserted into the net attaching bracket 55 through hole 65. Hole 60 is for attaching the net attaching bracket 55 with a fastener to the leaf net 25 and is off set at the same angle as the mounting pole 50 so that a side of the leaf net 25 closest to the clamping means 15 is positioned parallel with respect to a plane formed by a sidewall 21 of the swimming pool 20.

Figure 5:
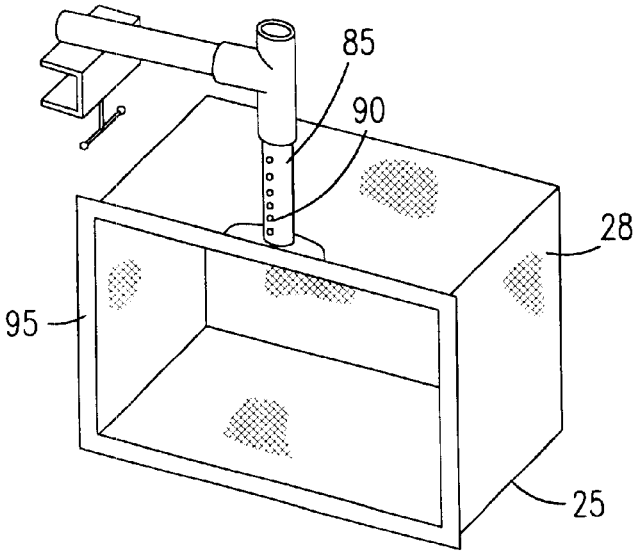
FIG. 5 is a front perspective view of a commercially available leaf net modified for use with the present invention.

Finally, FIG. 5 shows a commercially available rectangular/oval leaf net 25. Attachment tube 85 has additional height adjustment holes 90 drilled/punched into it that a standard commercially available leaf net does not have drilled/punched into it. The height adjustment holes 90 allow the leaf net 25 to be positioned at its proper height in the swimming pool's water 10 and 12 (FIG. 1) to maximize surface debris collection. Metal/plastic entrance frame 95 keeps net 28 open to allow surface debris collection and removal. Debris removal from net 28 can be accomplished by removing the net attaching bracket 55 and attached leaf net 25 from the mounting pole 50.

2. Operation of the Preferred Embodiment

In operation, the present invention is affixed directly to the sidewall of a conventional swimming pool in a manner such that the leaf collection net is positioned to span across the surface of the water. When placed a short distance from the main pool filter's discharge point, the natural circulation of the swimming pool and centrifugal force brings the swimming pool's surface debris to the leaf net. Further, the stationary pool leaf net filter apparatus can be easily cleaned of collected debris by turning the leaf net upside down over a debris collection receptacle and gently shaking or tapping the collected debris out. Also, by turning the leaf net inside out and spraying the collected debris off of the leaf net with a standard garden hose the device can be cleaned and reinstalled for continuous filtering.

The foregoing is considered as illustrative only of the principles of this invention. Further, since numerous modifications and changes will readily occur to those skilled in the art, it is not desired to limit the invention to the exact construction and operation shown and described, and accordingly, all suitable modifications and equivalents may be resorted to, falling within the scope of this invention. Therefore, the scope of the invention is to be limited only by the following claims.

What is claimed is:

1. A stationary pool leaf net filter apparatus comprising:

a debris collecting net, said debris collecting net is removable for cleaning without loss of contained debris from a pocket type net element;

a mounting means affixed to said debris collecting net for attaching said debris collecting net to an edge of a swimming pool; and a net mounting pole means to connect said mounting means to the debris collecting net in a manner such that a side of said debris collecting net closest to a clamping means is positioned parallel with respect to a plane formed by a sidewall of the swimming pool;

wherein said debris collecting net and said mounting means can be detached for debris removal, and wherein detachment occurs without having a mechanical mechanism holding said mounting means on said net mounting pole means.

2. The stationary pool leaf net filter apparatus of claim 1, wherein said clamping means can be easily removed from said edge of said swimming pool for relocation or winter storage without leaving any holes behind in said edge of said swimming pool.

3. The stationary pool leaf net filter apparatus of claim 1, wherein said leaf net filter apparatus can be covered at night and when n said swimming pool is no t in use by the swimming pool's standard pool cover, and will remain in operation while the swimming pool's cover is covering said swimming pool.

4. The stationary pool leaf net filter apparatus of claim 1, wherein said apparatus is placed a distance from a main pool filter's discharge point where natural circulation of the swimming pool water and centrifugal force bring swimming pool surface debris to said debris collecting net.

5. A stationary pool leaf net filter assembly for attachment to an outer top edge of a swimming pool, said assembly comprising:

a clamping means for r affixing a net attaching bracket to a sidewall of a conventional swimming pool;

a net attaching bracket for supporting a net; and a net formed at a distal end of a mounting pole such that said net partially extends into a swimming pool's water so that a portion of said net is above a water line of the swimming pool and a balance of said net is below the waterline;

wherein said clamping means comprises:

a threaded rod shaft having an upper end and a lower end;

a swivel cap terminating said upper end of said threaded rod shaft so that said d threaded rod shaft will not rotate against a pool edge;

a handle in physical communication with the lower end of said threaded rod shaft opposite said swivel cap for urging said threaded rod shaft in a rotating manner;

a clamp retaining said threaded rod shaft, wherein said clamp has a horizontal length for keeping said clamp from rotating due to any rotational force applied to said clamp and an upper edge of said clamp that extends laterally beyond a lower edge for additional upper clamping surface area;

a mounting pole, said mounting pole is attached perpendicularly along a linearly elongated centerline of an upper surface of said upper edge of said clamp, thereby forming an angle greater than 90° with respect to said mounting pole and a lateral, outer surface of said clamp, said mounting pole functions as an attachment means such that a net attaching bracket is held on by force of the swimming pool's circulating water; and a net attaching bracket connected to said net by means of a fastener offset at a same angle as said mounting pole such that a side of said net closest to said clamp is positioned parallel with respect to a plane formed by a sidewall of the swimming pool.

* * * * *